US011299934B2

(12) United States Patent
Brown et al.

(10) Patent No.: US 11,299,934 B2
(45) Date of Patent: Apr. 12, 2022

(54) EXPANDABLE WORK TRAY FOR A STEP STOOL OR LADDER

(71) Applicant: Dorel Home Furnishings, Inc., Wright City, MI (US)

(72) Inventors: Evan A. Brown, Campbellsburg, IN (US); Kyle J. Lawrence, Greenfield, IN (US)

(73) Assignee: Dorel Home Furnishings, Inc., Wright City, MI (US)

( * ) Notice: Subject to any disclaimer, the term of this patent is extended or adjusted under 35 U.S.C. 154(b) by 79 days.

(21) Appl. No.: 16/697,457

(22) Filed: Nov. 27, 2019

(65) Prior Publication Data

US 2020/0165869 A1 May 28, 2020

Related U.S. Application Data

(60) Provisional application No. 62/772,470, filed on Nov. 28, 2018.

(51) Int. Cl.
*E06C 7/14* (2006.01)
*E06C 1/393* (2006.01)

(52) U.S. Cl.
CPC ..... *E06C 7/14* (2013.01); *E06C 1/393* (2013.01)

(58) Field of Classification Search
CPC ..... E06C 7/14; E06C 1/393
See application file for complete search history.

(56) References Cited

U.S. PATENT DOCUMENTS

| | | | | |
|---|---|---|---|---|
| 771,572 | A * | 10/1904 | Plummer | |
| 814,572 | A * | 3/1906 | Thilborger | |
| 1,169,638 | A * | 1/1916 | Hammond | G09F 5/02 190/17 |
| 2,865,546 | A | 12/1958 | Shull | |
| 2,957,542 | A | 10/1960 | Rizzuto | |
| 3,625,388 | A | 12/1971 | Golden et al. | |
| 3,744,591 | A | 7/1973 | Lucci et al. | |
| 4,502,564 | A | 3/1985 | Kummerlin et al. | |
| 4,936,463 | A | 6/1990 | Tiramani | |
| 4,979,590 | A | 12/1990 | Bailey | |
| 5,052,581 | A | 10/1991 | Christ et al. | |
| 5,516,202 | A * | 5/1996 | Markezin | B44D 3/02 190/17 |
| 5,573,081 | A | 11/1996 | Bartnicki et al. | |
| 5,613,574 | A | 3/1997 | Melanson | |
| 5,673,885 | A | 10/1997 | Pham | |
| 5,722,507 | A | 3/1998 | Kain | |
| 5,740,883 | A | 4/1998 | Trank | |
| 5,873,433 | A | 2/1999 | Katz | |
| 5,913,380 | A | 6/1999 | Gugel et al. | |
| 6,443,260 | B1 | 9/2002 | Katz et al. | |
| 6,467,577 | B1 | 10/2002 | Charlebois, Jr. | |
| 6,902,034 | B2 | 6/2005 | Gibson et al. | |
| 7,000,732 | B1 | 2/2006 | Briggs, Jr. | |
| 7,032,711 | B1 | 4/2006 | Katz et al. | |

(Continued)

*Primary Examiner* — Alvin C Chin-Shue
(74) *Attorney, Agent, or Firm* — Barnes & Thornburg LLP

(57) ABSTRACT

A step stool includes an expandable tray assembly. The expandable tray assembly has a fixed tray panel and a movable tray panel coupled to the fixed tray unit for movement relative to the fixed tray unit. The movable tray panel is illustratively movable between a collapsed position, arranged above the fixed tray panel, and an expanded position, arranged adjacent to the fixed tray panel.

11 Claims, 2 Drawing Sheets

(56) References Cited

U.S. PATENT DOCUMENTS

Figure 1:
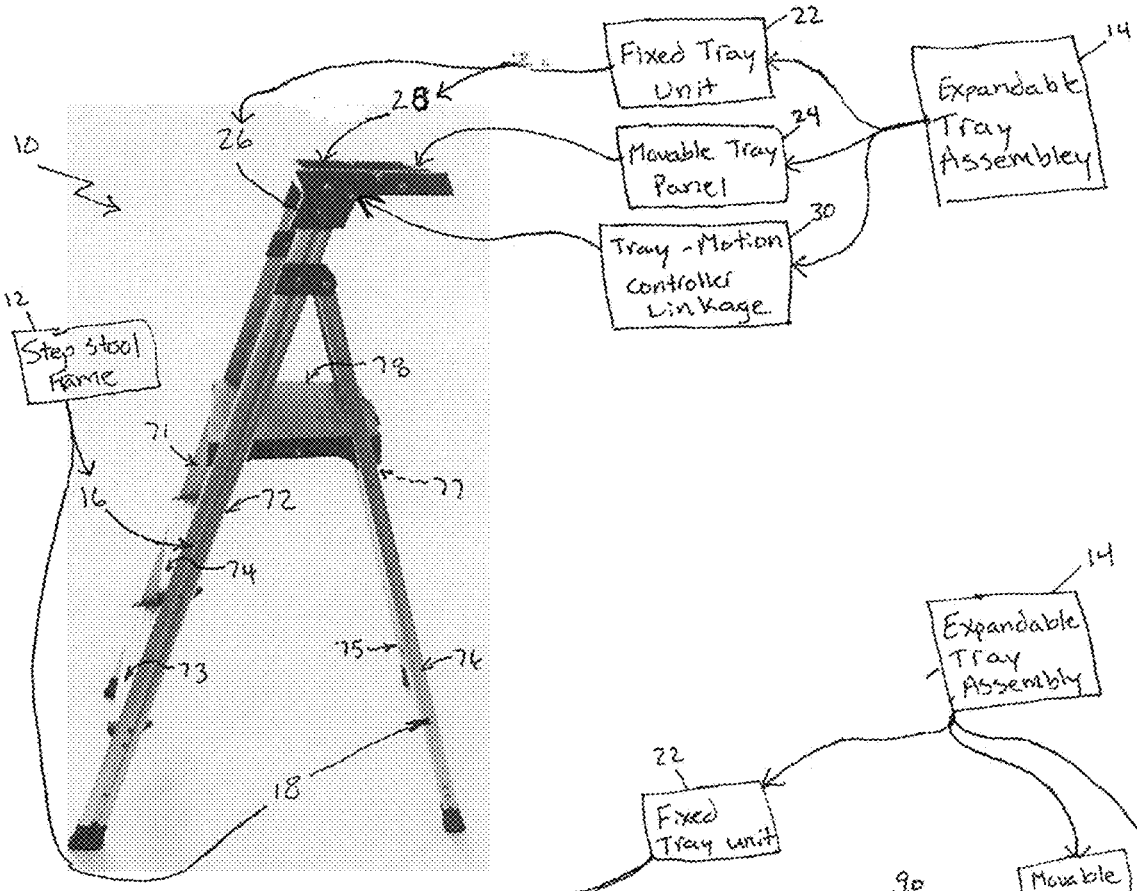

| | | | | |
|---|---|---|---|---|
| 7,108,103 | B2 | 9/2006 | Meeker | |
| 7,370,726 | B1 | 5/2008 | Chavez | |
| 7,967,111 | B2 | 6/2011 | Meyers et al. | |
| D642,283 | S | 7/2011 | Eriksson | |
| 8,186,481 | B2 | 5/2012 | Moss et al. | |
| 8,596,454 | B1 | 12/2013 | Carlson | |
| 8,636,144 | B1 * | 1/2014 | Lawery | E06C 7/14 206/234 |
| 9,309,718 | B1 | 4/2016 | Matthew | |
| 10,138,680 | B2 * | 11/2018 | Williams | E06C 7/14 |
| 2002/0104709 | A1 | 8/2002 | Hines | |
| 2003/0029676 | A1 | 2/2003 | Gibson et al. | |
| 2006/0006024 | A1 | 1/2006 | Till | |
| 2007/0120028 | A1 | 5/2007 | Kane | |
| 2009/0272602 | A1 | 11/2009 | Kocher | |
| 2010/0224445 | A1 | 9/2010 | Moss et al. | |
| 2012/0211305 | A1 | 8/2012 | Moss et al. | |
| 2012/0228059 | A1 | 9/2012 | Lampe et al. | |
| 2013/0128557 | A1 * | 5/2013 | Pereira | E06C 7/14 362/145 |
| 2013/0270037 | A1 | 10/2013 | Pensieri et al. | |
| 2015/0014094 | A1 | 1/2015 | Brooks | |
| 2015/0090533 | A1 | 4/2015 | Moss et al. | |
| 2016/0024845 | A1 | 1/2016 | Coe | |
| 2016/0038789 | A1 | 2/2016 | Cheyne | |
| 2016/0177626 | A1 | 6/2016 | Miller | |
| 2018/0023345 | A1 * | 1/2018 | Andrade | A47B 13/083 108/25 |

* cited by examiner

EXPANDABLE WORK TRAY FOR A STEP STOOL OR LADDER

PRIORITY CLAIM

This application claims priority under 35 U.S.C. § 119(e) to U.S. Provisional Application Ser. No. 62/772,470, filed Nov. 28, 208, which is expressly incorporated by reference herein.

BACKGROUND

The present invention relates to a step stool, and particularly to a folding step stool including legs that fold between an opened use position and a folded storage position. More particularly, the present invention relates to a tray assembly used for storing or holding articles associated with the use of the step stool.

Step stools have a frame and one or more steps that individuals use for elevation when reaching for objects, painting walls, or any everyday task where extra elevation would be helpful. Step stool frames are often foldable for ease of storage while the step stool is not being used. Additionally, a tray assembly may be included to facilitate holding items.

SUMMARY

According to the disclosure, a step stool includes a frame having legs movable relative to each other between an opened use position and a folded storage position. The step stool frame includes an upper portion and a lower portion. At least one step is coupled to the lower portion. An expandable tray assembly is provided having a fixed tray unit mounted to the upper portion and a movable tray panel coupled to the fixed tray unit for movement relative to the fixed tray unit. The movable tray panel is illustratively movable between a collapsed position, arranged above the fixed tray unit, and an expanded position, arranged adjacent to the fixed tray unit.

In illustrative embodiments, the expandable tray assembly includes a tray-motion controller linkage that guides movement of the movable tray panel between the collapsed position and the expanded position. The tray-motion controller linkage is configured to guide the movable tray panel during motion from the collapsed position to the expanded position so as to maintain a top surface of the movable try panel in an upwardly-facing orientation so that objects supported in compartments of the movable tray panel can remain in place during transition from the collapsed position to the expanded position.

Additional features of the invention will become apparent to those skilled in the art upon consideration of the following detailed description of preferred embodiments exemplifying the best mode of carrying out the invention as presently perceived.

BRIEF DESCRIPTIONS OF THE DRAWINGS

Figure 2:
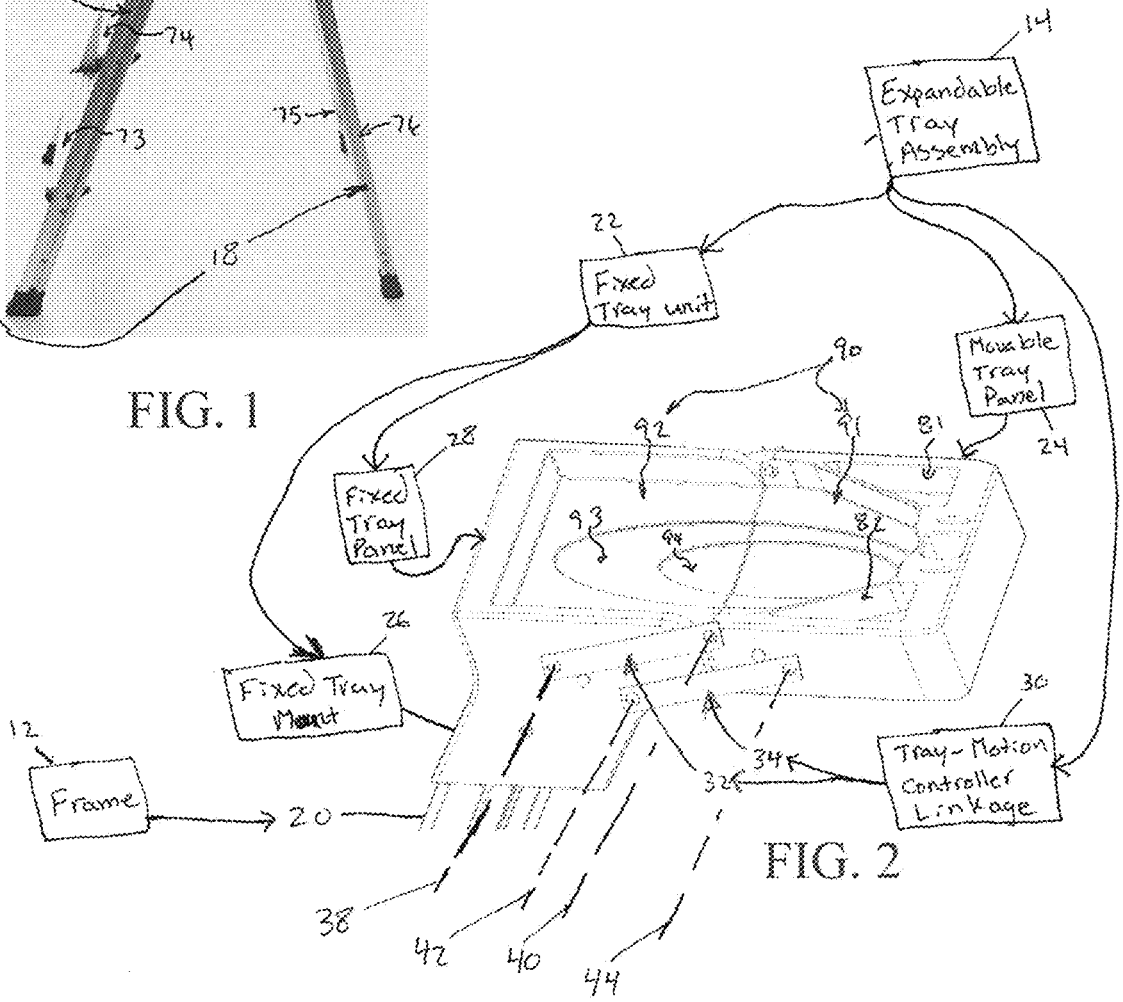
Figure 3:
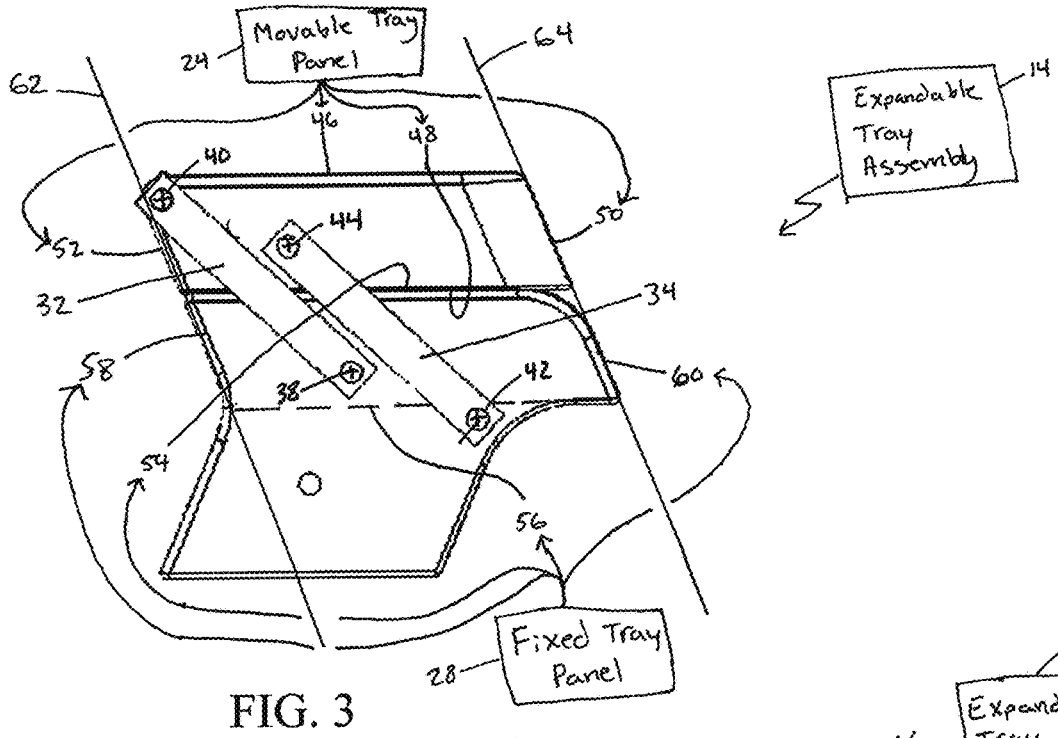
Figure 4:
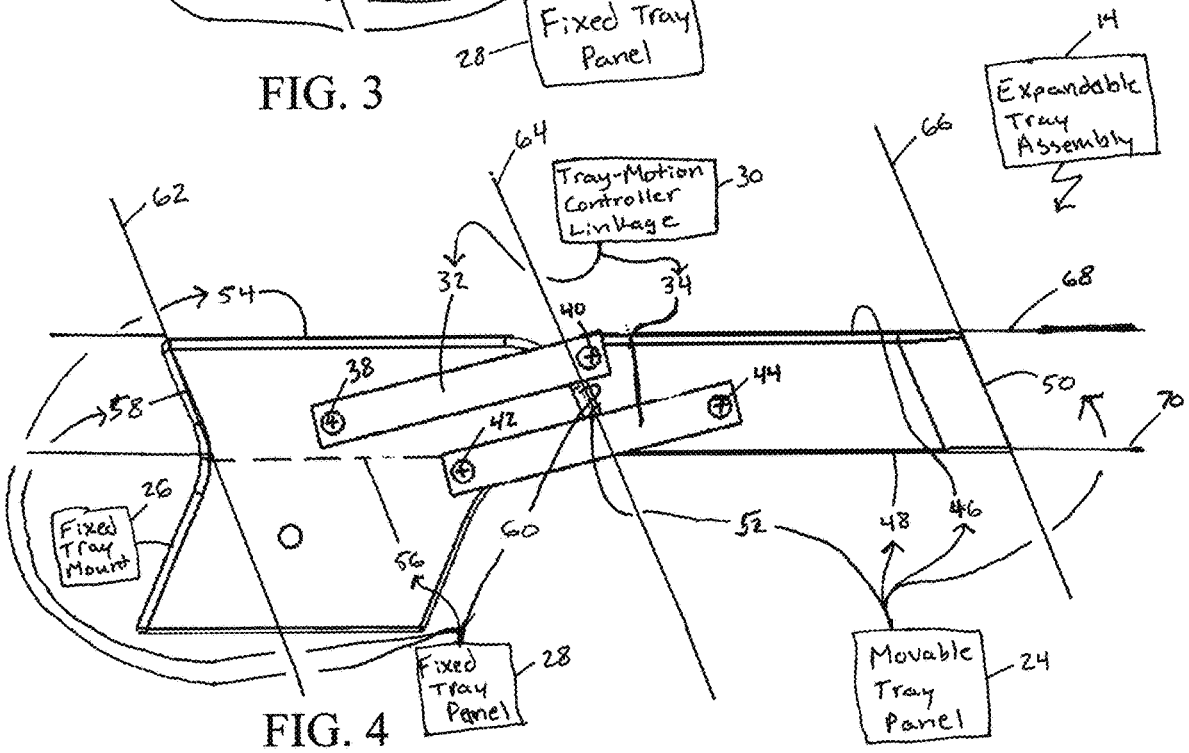

FIG. 1 is a perspective view of a step stool including a foldable step stool frame and an expandable tray assembly that provides a relatively-small or a relatively-large support area for a user on the step stool frame showing that the expandable tray assembly is coupled to an upper portion of the step stool frame;

FIG. 2 is a perspective view of the upper portion of the step stool frame and the expandable tray assembly of FIG. 1 showing that the expandable tray assembly includes a fixed tray unit with a fixed tray panel, a movable tray panel coupled to the fixed tray panel for motion relative to the fixed tray panel, and a tray-motion controller linkage including forward links and rear links that control movement of the movable tray panel from a collapsed position, shown in FIG. 3, to an expanded position, shown in FIG. 4, in such a way so as to maintain a top surface of the movable try panel in an upwardly-facing orientation so that objects supported in compartments of the movable tray panel can remain in place during transition from the collapsed position to the expanded position;

FIG. 3 is a side elevation view of the step stool of FIG. 1 showing the movable tray panel in the collapsed position resting on top of the fixed tray and positioned in an upwardly-facing orientation such that a bottom surface of the movable tray panel abuts a top surface of the fixed tray panel, a forwardly-facing surface of the fixed tray panel is aligned with a forwardly-facing surface of the movable tray panel along a forward plane, and rearwardly-facing surface of the fixed tray panel is aligned with a rearwardly-facing surface of the movable tray panel along an intermediate plane parallel with the forward plane; and FIG. 4 is a side elevation view of the expandable tray assembly similar to that shown in FIG. 3, except that the movable tray panel has been moved from the collapsed position to the expanded position while still being positioned in the upwardly facing orientation with the movable tray panel adjacent to the fixed tray panel showing that a top surface of the movable tray panel is coplanar with the top surface of the fixed tray panel, the bottom surface of the movable tray panel is coplanar with a bottom surface of the fixed tray panel, the forwardly-facing surface of the fixed tray panel is positioned along the forward plane, the rearwardly-facing surface of the movable tray panel is positioned along a rearward plane parallel to the forward plane, and the rearwardly-facing surface of the fixed tray panel and the forwardly-facing surface of the movable tray panel are positioned along the intermediate plane in abutting relationship with one another to allow the fixed tray panel to provide cantilevering support to the movable tray panel when the expandable tray assembly is in the expanded position.

DETAILED DESCRIPTION

A step stool 10 includes a step stool frame 12 and expandable tray assembly 14 coupled to the step stool frame 12, as shown in FIGS. 1 and 2. The step stool frame 12 includes a front leg unit 16 and a rear leg unit 18 pivotably coupled to the front leg unit 16 for movement from a closed storage position to an opened use position, as suggested in FIG. 1. The expandable tray assembly 14 is coupled to an upper portion 20 of the step stool frame 12 and is reconfigurable between an expanded configuration shown in FIGS. 1, 2, and 4 and a collapsed configuration shown in FIG. 3.

The expandable tray assembly 14 includes a fixed tray unit 22 and a movable tray panel 24 movable relative to the fixed tray unit 22, as shown in FIG. 2. The fixed tray unit 22 includes a fixed tray mount 26 coupled to the upper portion 20 of the step stool frame 12 and a fixed tray panel 28 coupled to the movable tray panel 24 and the fixed tray mount 26. The movable tray panel 24 is movable relative to the fixed tray panel 28 to establish the collapsed position and the expanded position. The expandable tray assembly 14 further includes a tray-motion controller linkage 30 configured to control movement of the movable tray panel 24 between the collapsed position and the expanded position, as shown in FIGS. 1-4.

The tray-motion controller linkage 30 includes forward links 32 and rear links 34 each pivotably coupled to the fixed tray panel 28 and the movable tray panel 24. The forward links 32 and rears links 34 guide motion of the movable tray panel 24 in such a way so as to maintain a top surface 46 of the movable tray panel 24 in an upwardly-facing orientation so that objects supported in compartments 81, 82 formed in the top surface 46 of the movable tray panel 24 can remain in place while the expandable tray assembly 14 transitions from the collapsed position to the expanded position, as suggested in FIG. 2.

The forward links 32 of the tray-motion controller linkage 30 are pivotably coupled to the fixed tray panel 28 for rotation about the first-fixed-tray-panel axis 38 and pivotably coupled to the movable tray panel 24 for rotation about the first-movable-tray-panel axis 40, as shown in FIG. 2. The rear links 34 are pivotably coupled to the fixed tray panel 28 for rotation about the second-fixed-tray-panel axis 42 and pivotably coupled to the movable tray panel 24 for rotation about the second-movable-tray-panel axis 44.

The movable tray panel 24 includes the upwardly-facing top surface 46, a bottom surface 48 opposite the top surface 46, a rearwardly-facing surface 50 extending between the top surface 46 and the bottom surface 48, and a forwardly-facing surface 52 positioned opposite the rearwardly-facing surface 50 and extending between the top surface 46 and the bottom surface 48, as shown in FIGS. 3 and 4. The movable tray panel 24 rests on top of the fixed tray panel 28 in the upwardly-facing orientation when the expandable tray assembly 14 is in the collapsed configuration shown in FIG. 3. The movable tray panel 24 is supported adjacent to the fixed tray panel 28 in the upwardly-facing orientation when the expandable tray assembly 14 is in the expanded configuration shown in FIG. 4.

The fixed tray panel 28 includes an upwardly-facing top surface 54, a bottom surface 56 opposite the top surface 54, a rearwardly-facing surface 60 extending between the top surface 54 and the bottom surface 56, and a forwardly-facing surface 58 positioned opposite the rearwardly-facing surface 60 and extending between the top surface 54 and the bottom surface 56, as shown in FIGS. 3 and 4. When the expandable tray assembly 14 is in the collapsed configuration, as shown in FIG. 3, the bottom surface 48 of the movable tray panel 24 abuts and engages the top surface 54 of the fixed tray panel 28.

When the expandable tray assembly 14 is in the collapsed configuration, as shown in FIG. 3, the forwardly-facing surface 58 of the fixed tray panel 28 is aligned with the forwardly-facing surface 52 of the movable tray panel 24 along a forward plane 62. When the expandable tray assembly 54 is in the collapsed configuration, as shown in FIG. 3, the rearwardly-facing surface 60 of the fixed tray panel 28 is aligned with the rearwardly-facing surface 50 of the movable tray panel 24 along an intermediate plane 64. The intermediate plane 64 is parallel to the forward plane 62.

As discussed above, the tray-motion controller linkage 30 is configured to control movement of the movable tray panel 24 as the expandable tray assembly 14 moves between the collapsed position shown in FIG. 3 and the expanded position shown in FIG. 4. As the expandable tray assembly 14 moves between the collapsed configuration and the expanded configuration, the movable tray panel 24 remains in the upwardly facing orientation, as suggested by FIGS. 3 and 4.

When the expandable tray assembly 14 is in the expanded configuration, the movable tray panel 24 is adjacent to the fixed tray panel 28, as shown in FIG. 4. When the expandable tray assembly 14 is in the expanded configuration, the top surface 46 of the movable tray panel 24 is aligned with the top surface 54 of the fixed tray panel 28 along an intermediate-transverse plane 68, and the bottom surface 48 of the movable tray panel 24 is aligned with the bottom surface 56 of the fixed tray panel 28 along a bottom-transverse plane 70 parallel to the intermediate-transverse plane 68.

When the expandable tray assembly 14 is in the expanded configuration 14, the forwardly-facing surface 58 of the fixed tray panel 28 is positioned along the forward plane 62, the rearwardly-facing surface 50 of the movable tray panel 24 is positioned along a rearward plane 66 parallel to the forward plane 62 and the intermediate plane 64, and the rearwardly-facing surface 60 of the fixed tray panel 28 and the forwardly-facing surface 52 of the movable tray panel 24 are positioned along the intermediate plane 64, as shown in FIG. 4. The rearwardly-facing surface 60 of the fixed tray panel 28 and the forwardly-facing surface 52 of the movable tray panel 24 are positioned in confronting, abutting relationship with one another to allow the fixed tray panel 28 to support to the movable tray panel 24 when the expandable tray assembly 14 is in the expanded configuration.

In the illustrated embodiment, the movable tray panel 24 is shaped to define a recess 91 and the fixed tray panel 28 is formed to define a recess 92 as shown in FIG. 2. The recesses 91, 92 cooperate when the movable tray panel 24 is in the expanded use position to provide a compartment 90 surrounded on all sides by walls to retain items stored/placed therein. In particular, the compartment 90 is sized to receive paint cans and is further formed to include indentations 93, 94 sized to receive standard paint cans so as to discourage unwanted sliding of the paint cans when placed in the indentations 93, 94.

The front leg unit 16 illustratively includes legs 71, 72, and steps 73, 74 as shown in FIG. 1. The steps 73, 74 extend between the legs 71, 72 and provide footrests for a user climbing the step stool 10.

The rear leg unit 18 illustratively includes legs 75, 76 and a cross-member 77 as shown in FIG. 1. The cross-member 77 extends between the legs 75, 76. In the illustrated embodiment, a panel 78 is coupled to the legs 71, 72 of the front leg unit and selectively engages the cross-member 77 of the rear leg unit 16 to lock the step stool frame 12 in the opened use position as suggested in FIG. 1.

The invention claimed is:

1. A step stool comprising a step stool frame including a front leg unit having at least one step supported above ground underlying the step stool and a rear leg unit coupled to the front leg unit to pivot from a closed storage position to an opened use position, and an expandable tray assembly coupled to the step stool frame, the expandable tray including a fixed tray panel secured to the step stool frame, a movable tray panel mounted for movement relative to the fixed tray panel from a collapsed position arranged above the fixed tray unit to an expanded position arranged adjacent to the fixed tray unit, and tray-motion control means for guiding movement of the movable tray panel from the collapsed position to the expanded position such that during motion a top surface of the movable try panel is maintained in an upwardly-facing orientation so that objects supported on the movable tray panel can remain in place during transition from the collapsed position to the expanded position, wherein the movable tray panel is shaped to define a first recess surrounded only by a first outermost sidewall and a second outermost sidewall opposite and parallel to the first outermost sidewall and a rearwardly-facing end wall, the fixed tray panel is formed to define a second recess surrounded by a third outermost sidewall and a forwardly-facing end wall and a fourth outermost sidewall opposite and parallel to the third outermost sidewall, the first and second recesses cooperate when the movable tray panel is in the expanded use position to provide a compartment surrounded on all sides by only the side walls and end walls of the movable tray panel and the fixed tray panel and without as wall dividing the first and second recesses to retain items placed therein, and at least a portion of the first outermost sidewall is aligned with and with the third outermost sidewall and at least a portion of the second outermost sidewall is aligned with the fourth outermost sidewall when the movable tray panel is in the expanded position.

2. The step stool of claim 1, wherein the tray-motion control means includes a tray-motion controller linkage, and the tray-motion controller linkage includes (i) a forward link mounted for rotation about a first-fixed-tray-panel axis and pivotably coupled to the movable tray panel for rotation about a first-movable-tray-panel axis and (ii) a rear link mounted for rotation about a second-fixed-tray-panel axis and pivotably coupled to the movable tray panel for rotation about a second-movable-tray-panel axis.

3. The step stool of claim 2, wherein the movable tray panel rests on top of the fixed tray panel in the upwardly-facing orientation when the expandable tray assembly is in the collapsed position; and, wherein the movable tray panel is adjacent to and engaged with the fixed tray panel in the upwardly-facing orientation when the expandable tray assembly is in the expanded position.

4. The step stool of claim 3, wherein the fixed tray panel includes an upwardly-facing top surface, a bottom surface opposite the top surface, a rearwardly-facing surface extending between the top surface and the bottom surface, and a forwardly-facing surface positioned opposite the rearwardly-facing surface and extending between the top surface and the bottom surface; wherein the movable tray panel includes an upwardly-facing top surface, a bottom surface opposite the top surface, a rearwardly-facing surface extending between the top surface and the bottom surface, and a forwardly-facing surface positioned opposite the rearwardly-facing surface and extending between the top surface and the bottom surface;

wherein the bottom surface of the movable tray panel abuts and engages the top surface of the fixed tray panel when the expandable tray assembly is in the collapsed position; and, wherein the rearwardly-facing surface of the movable tray panel abuts and engages the forwardly-facing surface of the fixed tray panel when the expandable tray assembly is in the expanded position.

5. The step stool of claim 4, wherein the forwardly-facing surface of the movable tray panel is aligned with the forwardly-facing surface of the fixed tray panel along a forward plane when the movable tray is in the collapsed position, and wherein the forwardly-facing surface of the movable tray panel is positioned in confronting, abutting relation with the rearwardly-facing surface of the fixed tray panel when the movable tray is in the expanded position.

6. The step stool of claim 5, wherein the rearwardly-facing surface of the movable tray panel is aligned with the rearwardly-facing surface of the fixed tray panel along an intermediate plane when the movable tray panel is in the collapsed position, and wherein the rearwardly-facing surface of the movable tray panel is aligned along a rearward plane spaced from the intermediate plane when the movable tray panel is in the expanded position.

7. The step stool of claim 6, wherein the intermediate plane and the rearward plane are parallel to one another.

8. The step stool of claim 4, the top surface of the movable tray panel is aligned with the top surface of the fixed tray panel along an intermediate-transverse plane and the bottom surface of the movable tray panel is aligned with the bottom surface of the fixed tray panel along a bottom-transverse plane, parallel to the intermediate-transverse plane, when the movable tray panel is in the expanded position.

9. The step stool of claim 2, wherein the expandable tray assembly includes a fixed tray mount integrally formed with the fixed tray panel and coupled to the step stool frame to fix the fixed tray panel in place relative to at least a portion of the step stool frame.

10. The step stool of claim 4, wherein the at least a portion of the first outermost sidewall that is aligned with the third outermost sidewall and the at least a portion of the second outermost sidewall that is aligned with the fourth outermost sidewall are located adjacent to the rearwardly-facing surface of the movable tray panel.

11. The step stool of claim 1, wherein the compartment formed by the first recess and the second recess is sized to receive paint cans and is further formed to include indentations sized to receive standard paint cans so as to discourage unwanted sliding of the paint cans when placed in the indentations.

* * * * *